United States Patent [19]

Brunetto et al.

[11] Patent Number: 4,959,046

[45] Date of Patent: Sep. 25, 1990

[54] APPARATUS FOR FEEDING ADHESIVE COATED STITCHES TO CONTINUOUS FORMS FOR BINDING THE FORMS

[75] Inventors: Lari Brunetto; Lucinao Mercatali, both of Florence, Italy

[73] Assignee: Officina Meccantica Giuseppe Conti, Florence, Italy

[21] Appl. No.: 211,429

[22] Filed: Jun. 24, 1988

[51] Int. Cl.[5] ..... B65H 35/00; B65H 35/07

[52] U.S. Cl. ..... 493/382; 156/517; 156/519; 156/522; 493/345; 493/347; 493/380

[58] Field of Search ..... 493/345, 347, 380, 382; 156/517, 519, 522

[56] References Cited

U.S. PATENT DOCUMENTS

| | | | |
|---|---|---|---|
| 2,723,604 | 11/1955 | Fischer | 493/345 |
| 3,012,481 | 12/1961 | Hughes | 493/347 |
| 3,325,335 | 6/1967 | Martensson | 156/522 |
| 3,540,969 | 11/1970 | Jorgensen | 493/347 |
| 3,856,604 | 12/1974 | Lukkarinen | 156/519 |
| 4,525,236 | 6/1985 | Vordi | 156/517 |

*Primary Examiner*—William E. Terrell
*Assistant Examiner*—Jack Lavinder
*Attorney, Agent, or Firm*—McGlew and Tuttle

[57] ABSTRACT

Apparatus for feeding stitches of adhesive tape for binders of continuous forms for tabulating machines with a sprocket wheel for feeding each stitches so as to insert the leading end of each stitch into a corresponding hole of the perforation provided at the margins of the forms. The forms and the stitches become superimposed to each other during a binding phase and a pair of rolls engaged then for moving the forms and fixing the leading ends of every point under the lower form. A pair of rolls are provided for moving the adhesive tape in a direction perpendicular to the forms advancement, and intermittent advancement is obtained through a ratchet system associated with a "cosmodrome" cam; a head vertically rotating in the direction of the forms advancement, is provided at least with an eccentric cutting edge and a corresponding presser to operate, at every revolution. The cutting of the adhesive tape is done to obtain a binding stitch therefrom which is moved into cooperation with a facing rubber-coated roll which lifts the forms from the tail trailing end of the stitch off the upper form. A drive is provided for carrying out the rotation of the head in synchronism with the advancement of the forms to be bound, and an arrangement for carrying out the advancement of the adhesive tape in synchronism with the rotation of the head.

2 Claims, 2 Drawing Sheets

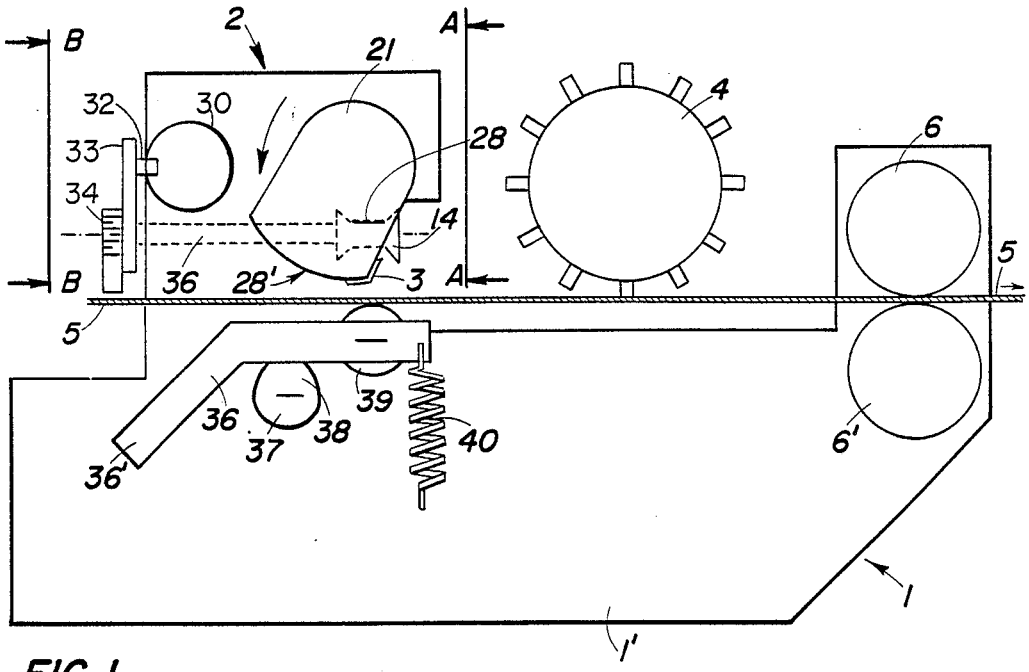
FIG. 1
FIG. 2
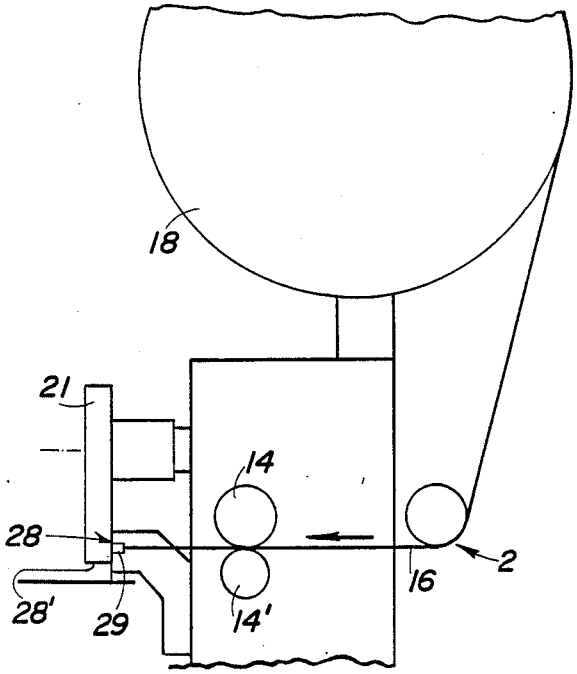
FIG. 3
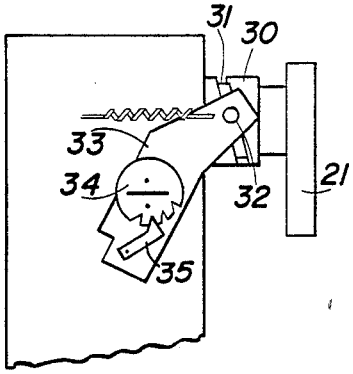

APPARATUS FOR FEEDING ADHESIVE COATED STITCHES TO CONTINUOUS FORMS FOR BINDING THE FORMS

FIELD AND BACKGROUND OF THE INVENTION

The present invention relates to an apparatus for feeding strips of gummed (adhesive) tape for binding to continuous interconnected paper forms for tabulating machines.

It is known that present day binder machines for binding continuous forms for tabulating machines comprise a sprocket wheel, located downstream of the apparatus for feeding binding strips in the form of adhesive tape, for the insertion of the leading end of each binding strip into a corresponding hole of perforations provided at the margin of the various forms arranged in overlapping relationship. The apparatus also includes a pair of form driving rolls, the lower roll having also the function of folding the leading end of the binding strip and fixing it to the lower page of an underlying form.

These known binders for continuous forms further provide the feeding of stitches or strips of adhesive tape perpendicularly to the forms feeding direction, and cutting the stitches from a continuous tape having a width equal to the stitch length, by means of a straight blade provided with vertical reciprocating motion.

The particular construction, operating cycle and drive means provided for these known binders for continuous forms set a limitation to the blade speed and to the regular application of strips and, therefore, a limitation to the advancement speed of the forms to be bound and thus to the machine output.

Also known, from the European patent No. 0054.009 is a binder for continuous forms wherein the adhesive tape, which is fed in a form advancement direction has a width equal to that of the stitches. The tape is cut, and then torn away, in order to form the binding stitches by means of two opposite rotating pressers; one of which is associated with a punch and the other to a notcher. However, a binder has the drawback of using an adhesive tape which is not easily available on the market.

SUMMARY OF THE INVENTION

The present invention eliminates the drawbacks of the prior binders by providing an apparatus for feeding the binding stitches which allows the utilization of a commercially available adhesive tape and it also provides a feeding speed and stitch cut accuracy and reliability a great deal higher than those so far obtained with the known binders.

According to the invention, an apparatus for feeding stitches of adhesive tape comprises a pair of rolls for driving the adhesive tape in a direction perpendicular to one of the paper forms to be bound. Intermittent advancement is obtained by means of a ratchet system associated with a so called "cosmodrome" cam with a vertically rotating head and at least an eccentric cutting edge. Included is a corresponding presser for operating the cut of the adhesive tape thereby obtaining a binding stitch therefrom. Afterwards, the tail or trailing end, of the stitch on the upper form is fixed by in cooperation with a facing roll which, by lifting the forms, generates a counterpressure. A drive is provided for rotating the head in synchronism with the advancement of the forms to be bound as well as a drive for advancing the adhesive tape in synchronism with the rotation of the head as well as a device for lifting the counter-pressure roll in synchronism with the head rotation.

Advantageously, according to the invention, there is a guiding of the adhesive tape, in the vicinity of the rotating head, through a funnel-like passage whose lower edge acts as a c counter-plate during the cutting of the tape.

Moreover, according to the invention, there is provided a mounting for the counter-pressure roll at the free end of a lever and a lifting device including a cam rotating in synchronism with the rotating head.

According to further characteristics, the rotating head comprises two diametrically opposite eccentric cutting edges and, accordingly, the "cosmodrome" cam is so shaped as to generate two equal angular displacements of the ratchet system shaft in synchronism with every revolution of the head. Also, the cam which causes the lifting of the lever carrying the counterpressure roll has two active eccentricities.

The solution proposed by the present invention allows a high speed-operating and easily-adjustable binder to be realized which further permits the binding-stitch pitch to be varied by a simple modification of the head.

Accordingly, it is an object of the invention to provide an apparatus for binding adhesive coated strips to continuous perforated forms for tabulating machines which comprises feeding the continuous forms having aligned perforations along a feed path and feeding a continuous strip of adhesive coated material in a direction in which intercepts the feed path and places the strip in contact with a rotatable head which is rotatable over the feed path and has at least one eccentric portion with an eccentric arcuate cutting edge at its periphery and a concentric roll portion adjacent one end of the cutting edge, the tube being effective to cut away a length of strip material and to hold the material for subsequent positioning directly on the forms overlying the perforations and which cooperates with a flexible material coated roller which is mounted on mounting means which periodically moves the roller into engagement with the eccentric head to wipe over the severed lengths of strip material to engage it onto the head member and then for engaging it onto the form overlying the perforations, the mechanisms including means for driving the parts synchronously so that they act to remove the strip material from its strip and place it on each form in succession.

A further object of the invention is to provide an apparatus for binding adhesive coated strips to continuous perforated forms which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

BRIEF DESCRIPTION OF THE DRAWINGS

In the drawings:

FIG. 1 is a schematic front view of a binder for continuous forms of a feeding apparatus constructed according to the invention;

FIG. 2 is a view taken along the line A—A of FIG. 1;

FIG. 3 is a view taken along the line B—B of FIG. 1;

DESCRIPTION OF THE PREFERRED EMBODIMENTS

Figure 4:
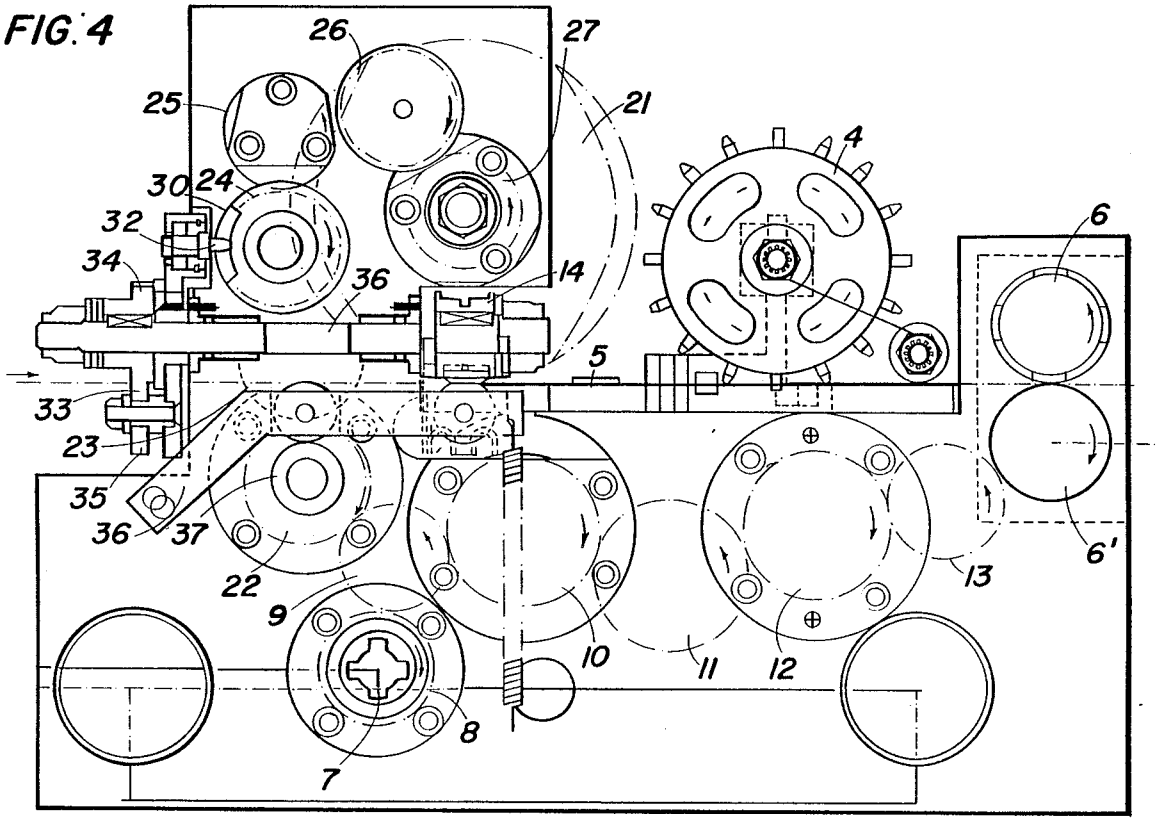
FIG. 4 shows a detailed view partly in section of the front of the binder of FIG. 1

Referring to the drawings in particular the invention embodied therein comprises an apparatus for binding adhesive coated strips 16 to continuous forms 5 which are moved along a feed path.

With reference to FIGS. 1, 2 and 3 of the attached drawings and reduced to its essential form, the apparatus according to the inventive binder or assembling device 1 uses strips of adhesive tape for continuous paper forms 5 for tabulating machines. The device 1 comprises an idle sprocket wheel 4, located downstream of a feeding device 2 which feeds the binding stitches 3. The leading end of each cut stitch 3 is inserted onto a corresponding hole of one of the perforations provided along the margin of superimposed forms 5. A pair of opposed rolls 6,6', rotating in opposite directions to one another and intended to move the forms are arranged along the feed path of the forms 5 and strips 3. The lower roll 6' also provides for the fixing of said leading end of each binding stitch 3 to the lower page of the underlying form 5.

With reference to FIG. 4 of the attached drawings, the roll 6' receives a rotational motion from a driving shaft 7 through a gear train comprising the toothed wheels or gears are, 9, 10, 11, 12 and 13 having a gear ratio equal to one The adhesive tape stitch feeding device generally designated 2 comprises a pair of opposed rolls 14, 14', rotating about axes parallel to the advancement direction or feed direction of the forms 5. The adhesive tape 16 is unwound from a coil 18 and is wound through an opening 29. A head 21 rotates about a horizontal axis in the plane of advancement of the forms 5 and in synchronism with the driving shaft 7 through a further gear train, with gear ratio equal to one, composed of the toothed wheels or gears 8, 9 and gears 22, 23, 24, 25, 26 and 27. This head 21 is provided with an eccentricity which has a cutting edge 28 and a corresponding back edge 28'. The back edge 28' has a circular profile and is concentric to the head axis. During every revolution of the head 21, the cutting edge 28 passes through the area adjacent the opening 29 thus cutting the portion of adhesive tape 16 projecting therefrom.

The cut strip or sticker 3, which is a few millimeter long (e.g. four) and defines the width of the binding strip, is determined by the intermittent rotation of a roll 14 obtained by means of a ratchet system of lever 33, ratchet 34 and dog 35 associated with a "cosmodrome" or barrel cam 30. The saw-teeth wheel or ratchet 34 is mounted on a shaft 36 of the roll 14 and the rocker lever 33, which is idle on shaft 36. The lever 33 carries, on one side, a pin 32 which is engaged in a race or groove 31 of the "cosmodrome" cam 30 and, on the other side, the pawl 35 engages the saw-teeth of the ratchet wheel 34.

A lever 36, having a fulcrum or pivot 36', is driven into vertical oscillation and in synchronism with the head 21 by means of a cam 37 mounted on the shaft of the gear 22 so that the rubber coated roll 39, idle-mounted at the free end of lever 36, is able to lift the forms 5 towards and against the back 28' of the head 21 thus determining the counter-pressure necessary to fix the tail (or trailing end) of stitch 3 on the form 50. The free end of the lever 36 is advantageously connected to an end of a spring 40 anchored to frame for its return to the rest position.

In order to achieve a binding pitch equal to half the normal one (of four inches), it is sufficient to change the head 21 with an eccentricity into a head with two eccentricities and thus with two cutting edges 28 and two corresponding diametrically opposite pressers 28'so as to operate two cuts of the adhesive tape. In this event the feed motion of the arm 37 is modified by the replacement of the "cosmodrome" cam with another whose slot 31 has two lifts able to supply two corresponding rotations of the cam shaft at every head revolution, and the replacement of cam 37 with another having two opposite lifts 38 allowing the lifting of roll 39 to be performed two times on every revolution.

Practically, the construction details may vary in equivalent manner in the form, dimensions, elements disposition, nature of the used materials without nevertheless coming out from the scope limits of the invention. industrial invention.

While specific embodiments of the invention have been shown and described in detail to illustrate the application of the principals of the invention, it will be understood that the invention may be embodied otherwise without departing from such principals.

What is claimed is;

1. An apparatus for feeding separate strips of adhesive tape for binders of continuous perforated forms for tabulating machines, comprising: sprocket wheel means for inserting the leading end of a cut adhesive tape strip into a selected hole of the perforations provided at a margin of the continuous perforated forms and a means for fixing the leading end of each cut adhesive tape strip under the continuous perforated forms; a pair of overhanging rolls, each overhanging roll having a horizontal axis substantially parallel to an advancement direction of the forms, said overhanging rolls driving the adhesive tape; ratchet means having a cam element connected to said overhanging rolls to drive said overhanging rolls with intermittent advancement; cutting head means, vertically rotating over the path of feed of said forms, said cutting head means having at least one eccentric cutting edge and a concentric back portion to cut the adhesive tape, said cutting head means cutting a strip of adhesive tape and then positioning the cut adhesive tape strip above said continuous forms facing said cutting head means; rubber-coated counter-pressure roll means movable for lifting the continuous forms and for contacting and engaging the trailing end of the cut adhesive tape strip with the lifted form, said ratchet means driving said head in synchronism with the advancement of the forms to be bound and in synchronism with the advancement of the adhesive tape; and, means to cause the lifting of the counter-pressure roll in synchronism with the rotation of said cutting head means.

2. An apparatus according to claim 1, wherein said counter pressure roll means comprises a rubber roll, a pivotally mounted member positioned alongside said cutting head means, said rubber roll being mounted at an end of said pivotally mounted member, said pivotally mounted member being connected to said means to cause lifting for periodically raising and lowering said rubber coated roller.

* * * * *